United States Patent [19]

Dressler

[11] 4,009,995

[45] Mar. 1, 1977

[54] PROCESS FOR DYEING MOLDED ARTICLES CONTAINING UREA FORMALDEHYDE RESIN OR MELAMINE FORMALDEHYDE RESIN

[76] Inventor: Hans Dressler, 1236 Catalina Drive, Monroeville, Pa. 15146

[22] Filed: Dec. 5, 1975

[21] Appl. No.: 637,891

[52] U.S. Cl. ..... 8/4; 8/1 E; 8/185

[51] Int. Cl.[2] ..... D06P 1/382; D06P 3/02

[58] Field of Search ..... 8/4, 1 E, 185

[56] References Cited

UNITED STATES PATENTS 2,128,533 8/1938 Howald ..... 18/61

OTHER PUBLICATIONS

J. of Soc. of Dyeing & Colourist, Dec. 1945, The Coloring of Plastics, Oehlcke, pp. 306–310.

Interchemical Review, Dip Dyeing of Plastics, F. Koberlein, pp. 74–77 Autumn 1946.

British Plastics, Apr. 1950, pp. 190–194, Surface Dyeing of Plastics.

*Primary Examiner*—John Kight, III

[57] ABSTRACT

Molded synthetic plastic articles containing urea formaldehyde or melamine formaldehyde are dyed after molding. The molded synthetic plastic article is treated in an aqueous dye bath containing 0.005 to 5.0 wt. % of a dichlorotriazinyl dye or a premetalized dye at a temperature in the range of 50° to 100° C.

13 Claims, No Drawings

PROCESS FOR DYEING MOLDED ARTICLES CONTAINING UREA FORMALDEHYDE RESIN OR MELAMINE FORMALDEHYDE RESIN

BACKGROUND OF THE INVENTION

The process of this invention relates to dyeing molded plastic articles containing predominantly urea formaldehyde resin or melamine formaldehyde resin. More particularly the process of this invention relates to dyeing buttons made predominantly of urea formaldehyde resin or melamine formaldehyde resin by a post-molding treatment.

Molded synthetic plastic articles like buttons, clock cases, display boxes, closures, electric razor housings, lighting fixtures and reflectors, tableware, electric wall plates, kitchen accessories and housewares of all types are produced in a variety of colors. These articles are colored by adding a dye to the synthetic plastic after it is molded or by adding a dye or pigment to the synthetic plastic while it is in a pre-molded form; i.e., a powdered form. When the molded synthetic plastic articles are made of polyester, methacrylate, polyamide, polystyrene and polyethylene, the dye may be added either before or after molding. For example, buttons molded from methacrylate and polyester are dyed after molding by a surface treatment with dispersion dyes. The buttons have a good to adequate dry cleaning fastness, iron fastness, rubbing fastness, water fastness and wash fastness. When the molded synthetic plastic articles are molded from urea formaldehyde or melamine formaldehyde, with or without a filler, the dye is usually added to the synthetic plastic material while it is in a pre-molded form. Only recently it has been suggested to dye synthetic plastic articles molded from urea formaldehyde resin after molding.

It has been suggested that buttons of pure urea formaldehyde resin can be dyed after molding with a specific acid dye. The buttons are immersed in a dye bath containing "Uresol" colorant (dye) in an amount in the range of 0.30 to 0.59 wt. % and "Urelux" fixer (stabilizer) in an amount in the range of 0.10 to 0.30 wt. % and acetic acid 80 to 85% in an amount in the range of 0.31 to 0.62 wt. % and water in an amount of 98.49 to 99.29 wt. %. The "Uresol" colorant and "Urelux" fixer are available from Synterge in Varese, Italy. The temperature of the dye bath should not exceed 60° C. and preferably should be in the range of 50° to 55° C. The urea formaldehyde buttons dyed by the dye and process mentioned above do not have the best available detergent wash fastness.

Reactive dyes have been used for dyeing cellulosic fibers, wool, nylon, acetate, polyester fibers and leather. Amino-substituted dyes are readily associated with the dichlorotriazinyl group by reaction with cyanuric chloride. These dichlorotriazinyl dyes are very reactive with cellulosic fibers. This reaction with cellulose may occur by nucleophilic substitution or by nucloephilic addition. The former yields cellulose esters while the latter yields cellulose ethers. The dichlorotriazinyl dyes are applied to the cellulose fibers in an aqueous weakly basic or weakly acidic dye bath. This treatment is usually followed by a weakly alkaline aftertreatment.

A series of dichlorotriazinyl dyes containing the dichloro-s-triazinyl amino group purportedly reacts with cellulose at a temperature around 20° to 30° C. in soda-alkaline, salt-containing bath. This series of dyes is commercially available from Imperial Chemical Industries Ltd., Manchester M93DA, England. These dyes which are used for textile dyeing are not recommended for use at a temperature above 70° C. The manufacturer makes this recommendation because at temperatures greater than 70° C. a competitive reaction of hydrolysis occurs in addition to the reaction between the dye and the cellulose. The hydrolysis reaction produces hydroxy derivatives that are no longer capable of reaction with cellulose.

Premetallized dyes in 1:1 and 2:1 complexes of organic moiety to metal have been used as dyes for wool, nylon and silk. The metal is usually chromium or cobalt. These dyes are known for their excellent light fastness. A neutral or slightly acid dye bath is used to apply these dyes to the fibers.

An object of this invention is to provide a process for the post-mold dyeing of molded synthetic plastic articles that contain predominantly urea formaldehyde resin or melamine formaldehyde resin.

A further object of this invention is to provide a process for the post-mold dyeing of buttons containing predominantly urea formaldehyde resin or melamine formaldehyde resin resulting in dyed buttons having good, even shades and excellent sublimation fastness and dry cleaning fastness, and satisfactory to excellent detergent and/or bleach wash fastness.

SUMMARY OF THE INVENTION

In accordance with this invention there is provided a process for the post-mold dyeing of molded synthetic plastic articles containing predominantly urea formaldehyde resin or melamine formaldehyde resin. This process comprises treating the molded urea formaldehyde resin or melamine formaldehyde resin containing articles in an aqueous dye bath containing a dichlorotriazinyl or premetallized dye at a temperature in the range of 50° to 100° C. until the articles are adequately dyed.

The dichlorotriazinyl dyes are those dyes which are readily associated with the dichlorotriazinyl group. For example, these dyes may be associated with the dichlorotriazinyl group by an amino, oxygen or sulfur bonds. The premetallized dyes is a class of azo or azomethine dyes which are metallized (chelated) with chromium in most cases and sometimes cobalt and iron prior to application. These dyes are available in 1:1 and 2:1 complexes of organic moiety to metal.

When the dye bath contains a dichlorotriazinyl dye or mixtures of dichlorotriazinyl dyes the amount of the dye or dyes in the dye bath is at least 0.005 wt. %. The amount of dye or dyes in the dye bath should not exceed about 5 wt. % for economic reasons. The dye bath may be acidic, neutral or basic and may contain additives for cleaning the surface of the molded article as known to those skilled in the art. The molded articles should be treated in the dye bath from about one minute to about ten minutes. Longer treating times lead to the loss of dye because of hydrolysis. Shorter residence times would yield molded articles having insufficient color.

When the dye bath contains a premetallized dye or mixture of premetallized dyes the amount of dye is at least 0.01 wt. % of the dye bath. The upper limit of the amount of premetallized dye should not exceed 5.0 wt. % for economic considerations. The dye bath containing the premetallized dye may be acidic, basic or neutral. Also, additional additives may be added to the dye bath for cleaning the surface of the molded article. These additives are well known to those skilled in the art. The molded articles should be treated in the dye bath containing one or more premetallized dyes for at least about one minute. Since the premetallized dyes do not undergo a hydrolysis reaction, the upper limit on the residence time is only restricted by economic and practical considerations.

The molded articles treated in a dye bath containing one or more dichlorotriazinyl dyes or one or more premetallized dyes may be subjected to an after-treatment. The after-treatment would aid in fixing the dye or would remove any dye not fixed to the molded plastic article. The after-treatment may be a water rinse or an alkaline rinse or a soap rinse as known by those skilled in the art.

The molded articles containing predominantly urea formaldehyde resin or melamine formaldehyde resin contain the resin alone or in combination with a minor amount of fillers. The fillers that may be present with the resin in the synthetic plastic molded article and that are innocuous to the dyeing process of this invention include cellulose, wood flour, walnut shell flour, chopped cotton, glass fiber, paper pulps, synthetic fibers, and abestos.

DETAILED DESCRIPTION OF THE INVENTION

Although the process of this invention is applicable to any molded synthetic plastic article that is molded from urea formaldehyde resin or melamine formaldehyde resin, the process of the invention is particularly suited for dyeing buttons that are molded from urea formaldehyde resin or melamine formaldehyde resin. The process of this invention may be employed to dye buttons containing only urea formaldehyde resin or melamine formaldehyde resin. Also, the process of this invention is aptly suited for dyeing buttons containing predominantly urea formaldehyde resin or melamine formaldehyde resin along with a minor amount of filler. The filler which is typically used is cellulose although any other filler for urea formaldehyde resin or melamine formaldehyde resin known to those skilled in the art may be used. It is preferred to use the process of this invention to dye buttons composed of urea formaldehyde resin along with a minor portion of cellulose filler.

The molded synthetic plastic article or button may be made by any process known to those skilled in the art. For example, the pre-form formulation for the molded synthetic plastic article may be a fast cure or slow cure formulation. This formulation may be pre-warmed or introduced into the heated multi-cavity compression-type die or press at ambient temperatures. Typically within 30–45 seconds after the die or press is closed and polymerization is initiated the charge becomes rigid. After polymerization has advanced sufficiently, the plastic article cures and is discharged from the die or press. When the molded plastic article is a button containing predominantly urea formaldehyde resin or melamine formaldehyde resin along with a minor amount of cellulose, the cellulose is thoroughly impregnated with aqueous urea formaldehyde resin or melamine formaldehyde resin. The amount of urea formaldehyde resin or melamine formaldehyde resin is at least 25 wt. % of the button. The amount of cellulose or any other filler for urea formaldehyde resin or melamine formaldehyde resin known to those skilled in the art is not more than 75 wt. % and not less than 15 wt. % of the button. When the molded plastic article is a button containing urea formaldehyde resin or melamine formaldehyde resin along with a minor amount of cellulose filler, it is preferred to use the dichlorotriazinyl dyes instead of the premetallized dyes. Both dyes yield dyed buttons having excellent dry cleaning and sublimation fastness but the former dyes yield buttons having excellent detergent wash fastness while the latter dyes yield buttons having fair to good wash fastness.

When dichlorotriazinyl dyes are used on buttons containing predominantly urea formaldehyde resin along with a minor amount of cellulose filler, it is believed that the dye reacts with the urea formaldehyde rather than the cellulose. This belief does not limit or narrow the process of this invention. This belief is supported by the observation that although several types of reactive dyes which are designed to react with cellulose were tried, only the dichlorotriazinyl dyes gave good detergent or detergent-bleach wash fastness. The reaction must be relatively fast, since it takes place at 85°–100° C. where the dichlorotriazinyl dyes undergo a fast hydrolysis reaction at these temperatures.

The dichlorotriazinyl dyes that may be used with the process of this invention are preferably those amino-substituted reactive dyes that are readily associated with the dichlorotriazinyl group by reaction with cyanuric chloride.

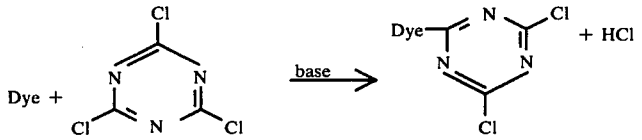

(cyanuric chloride)

Examples of the dichlorotriazinyl-amino-substituted reactive dyes from Color Index third edition, 1971, published by The Society of Dyers and Colorists, Bradford, Yorkshire, BD1 2JB England, that may be used, include: (C.I.) reactive blue 4 (C.I. constitution number 61205); C.I. reactive organe 1 (C.I. constitution number 17907); C.I. reactive red 2; C.I. reactive yellow 86; C.I. reactive brown 10; C.I. reactive blue 1; C.I. reactive orange 4; C.I. reactive red 1 (C.I. constitution number 181158); C.I. reactive red 11; C.I. reactive red 6 (C.I. constitution number 17965) C.I. reactive red 8 (C.I. constitution number 17908); C.I. reactive yellow 22; C.I. reactive yellow 1; C.I. reactive yellow 7; C.I. reactive yellow 4; C.I. reactive green 7; C.I. reactive brown 23; C.I. reactive blue 109; and C.I. reactive blue 161. These dyes may be obtained from Imperial Chemical Industries Ltd., Manchester M93DA, England, under the "Procion M" trademark. It is within the scope of this invention that any dye that readily associates with the dichlorotriazinyl group may be used. Example of other reactive dyes that can be associated with the dichlorotriazinyl group and used in the process of this invention includes: oxygen-substituted and sulfur-substituted reactive dyes.

A dye bath containing one or more dichlorotriazinyl type dyes, depending upon the color desired, is made preferably with a neutral pH, but acid and basic dye bath may be used. Enough dichlorotriazinyl type dye is added to an aqueous solution to give a dye bath containing 0.005 to 5 wt. % of dye. Other agents known to those skilled in the art may be added in small amounts to the dye bath to aid in cleaning the surface of the molded plastic article or button. The molded plastic article or button is preferably made of urea formaldehyde resin along with a minor amount of cellulose filler. An example of such a cleaning agent is "Synthrapol SP" general purpose detergent which is added in an amount to give a dye bath containing 0.1 to 2.0 wt. % (0.25 wt. %). This dye bath is contained in any dyeing vessel known to those skilled in the art of dyeing. The buttons are immersed in this dye bath at a temperature in the range of 50° to 100° C. and preferably 90° to 100° C. for a time in the range of about 0.5 to 30 minutes and preferably 1.0 to 10 minutes. These conditions limit the amount of dichlorotriazinyl type dye that undergoes hydrolysis. After dyeing, the buttons are preferably rinsed in hot water.

After the buttons are rinsed, it is preferred to treat the buttons in an after-treatment. The after-treatment may be any after-treatment known to those skilled in the art of post-cure dyeing. An example of such an aftertreatment is treating the rinsed dyed buttons in a bath containing a solution of 0.1 to 2.0 Wt. % sodium carbonate in water at a temperature in the range of 25°–75° C. for 5–30 minutes. The dyed buttons are then rinsed again with hot water and dried.

The above process may be conducted in a batch or continuous operation. In a continuous operation the buttons move from a dye bath to an after-treatment bath by a conveying means like baskets or buckets. The buttons remain in the bath long enough to achieve the appropriate residence time.

Shade variation in the dyeing of urea formaldehyde resin or melamine formaldehyde resin containing buttons can be readily obtained by mixing the dichlorotriazinyl type dyes. For instance 1 wt. % C.I. reactive yellow 86/1 wt. % C.I. reactive red 2 gave an orange-red shade, 1 wt. % C.I. reactive yellow 86/1 wt. % C.I. reactive blue 4 (61205) gave a green shade, 1 wt. % C.I. reactive brown 10/1 wt. % C.I. reactive yellow 86 gave a yellow brown shade, 1 wt. % of C.I. reactive blue 4 (61205)/1 wt. % C.I. reactive brown 10 gave a violet shade and 1 wt. % C.I. reactive blue 4 (61205)/1 wt. % C.I. reactive red 2 gave a purple shade.

In an alternative embodiment of this invention premetallized dyes are used to dye molded plastic articles containing predominantly urea formaldehyde or melamine formaldehyde in a post-molding operation. Preferably, the molded plastic articles are buttons made chiefly of urea formaldehyde resin along with a minor amount of cellulose filler. Representative premetallized dyes that can be used in the process of this invention include:

| C.I. Generic Name | C.I. Constitution No. |
|---|---|
| Acid Yellow 151 | |
| Acid Red 182 | |
| Acid Yellow 121 | 18690 |
| Acid Black 107 | |
| Acid Orange 60:1 | |
| Acid Black 52 | 15711 |
| Acid Red 184 | 15685 |
| Acid Red 186 | 18810 |
| Acid Orange 74 | 18745 |
| Acid Yellow 99 | 13900 |

-continued

| C.I. Generic Name | C.I. Constitution No. |
|---|---|
| Acid Orange 60 | |
| Acid Orange 69 | |
| Acid Yellow 54 | 19010 |

One or more of the premetallized dyes like those represented above are added to water to make a dye bath containing 0.01 to 5.0 wt. % of the premetallized dye. Preferably the dye bath has a neutral pH, but acidic and basic pH solution dye baths may be used. Again, a cleaning agent like "Synthrapol SP" detergent may be added to the dye bath. The buttons are immersed in the dye bath at a temperature in the range of 50° to 100° C. and preferably 80° to 100° C. for 0.5 to 30 minutes and preferably 5 to 20 minutes residence time. Preferably the dyed buttons are rinsed again with hot water and dried. The premetallized dyed buttons may be treated to an after-treatment but preferably an aftertreatment is not used. The dyeing operation with premetallized dyes may be conducted in a batch or continuous process. The continuous process would involve the use of conveying means like baskets to dip the articles or buttons in the dye bath and water rinse and drier for the appropriate residence time.

The following examples are given by way of illustration only and are not to be considered limiting in any manner.

EXAMPLE 1

A 400 ml beaker contained 200 ml of dye bath. The dye bath was a solution of 1.0 wt. % of C.I. reactive blue 4 (C.I. No. 61205) in water with addition of 0.25 wt. % "Synthrapol SP" detergent. After the bath was heated to 90°–100° C., 10 to 20 buttons with matte or glossy finish which were made of urea formaldehyde resin with a minor amount of cellulose, were charged to the bath. The charge was agitated so that the buttons were circling in the bath. After 5 to 10 minutes the buttons were removed from the bath and rinsed with hot water. Then the buttons were placed in an after-treatment bath at 50°–60° C. for 5–10 minutes to fix or remove any unreacted dye from the surface of the button. The after-treatment bath was a solution of 0.5 wt. % sodium carbonate in water. The dyed buttons were rinsed again with hot water and dried.

The urea cellulose buttons produced had a uniform, even blue color which had a high wash fastness and excellent dry cleaning fastness and sublimation fastness.

EXAMPLE 2

Same procedure as Example 1 but the urea-cellulose buttons were strung on a stainless steel wire and hung in the dye bath. The results were equivalent to those of the earlier process, but occasionally uneven dyeings were obtained where the stationary buttons touched sides.

The procedure of Example 1 was repeated several times with the use of one or more different dichlorotriazinyl dyes. These dyes included: C.I. (color index) reactive orange 1 (C.I. No. 17907), C.I. reactive red 2, C.I. reactive yellow 86, C.I. reactive brown 10 and mixtures of these dyes.

The dyed buttons produced had uniform and even shades.

EXAMPLE 3

A 400 ml beaker contained 200 ml dye bath. The dye bath contained 0.01 wt. % of 0.02 grams concentration of C.I. reactive red 2 along with 0.25 wt. % of "Synthrapol SP" detergent. The bath was heated to 90°–95° C. and the buttons made of urea formaldehyde resin with a minor amount of cellulose were placed in the bath for 10 minutes. The buttons removed from the dye bath had good deep shades.

EXAMPLE 4

Same procedure as Example 1 except buttons made of melamine formaldehyde with a minor amount of cellulose were dyed. These buttons proved to be more difficult to dye. The dyed buttons produced had pastel shades in ring-like patterns or matte and semi-glossy finishes. The dyed glossy buttons had only faint but even hues. The glossy buttons were etched in an acid bath to matte or semi-glossy finishes, therefore making the buttons easier to dye.

EXAMPLE 5

A 400 ml beaker contained 200 ml of dye bath. The dye bath was a solution of 1.0 wt. % C.I. Acid Yellow 121 (C.I. No. 18690) in water containing 0.25 wt. Synthrapol "synthrapol SP" detergent. The dye bath was heated to a temperature of 90°–100° C. Ten to twenty buttons which were made of urea formaldehyde resin with a minor amount of cellulose were placed in the bath. This charge of buttons was agitated so that the buttons were circling in the bath. After ten minutes the buttons were removed from the bath and rinsed with hot water and dried.

The procedure of Example 5 was repeated several times with the use of different premetallized dyes. These dyes included C.I. Acid Red 182, C.I. Acid Orange 60, C.I. Acid Black 107. The dyed buttons produced with the use of the premetallized dyes had a uniform and even color and deep shades were readily obtainable without darker dyed knit-lines which are imperfections in molding. The buttons dyed with the above-mentioned premetallized dyes were subjected to fastness tests. Generally, their dry cleaning and sublimation fastness were excellent and their fastness in the stringent detergent and detergent-bleach wash was fair to good.

The fastness tests include a detergent or detergent-bleach wash fastness, dry cleaning fastness and sublimation fastness. The latter is a test of migration of the dye due to heat. In the detergent wash test buttons were immersed in a 0.5 wt. % solution of "Oxydol" bleach containing detergent in water at 85° C. for 0.5 hour. Color fastness was judged visually. In the dry cleaning fastness test buttons were immersed in perchloroethylene at 50° C. for 0.5 hour. Color fastness was judged visually. In the sublimation fastness test buttons were held between two pieces of cloth ("Dacron" cloth and cotton) at 180° C. for 15 minutes. Visual inspection for color transfer from button to cloth was made.

According to the provisions of the patent statutes, I have explained the principle, preferred construction and mode of operation of my invention and have illustrated and described what I now consider to represent its best embodiment. However, I desire to have it understood that, within the scope of the appended claims, the invention may be practiced otherwise than as specifically illustrated and described.

I claim:

1. A process for dyeing molded articles containing urea formaldehyde resin or melamine formaldehyde resin comprising:

a. treating the molded articles in an aqueous dye bath containing one or more dyes selected from the group consisting of dichlorotriazinyl dyes or premetallized dyes at a temperature in the range of 50° to 100° C.

2. A process according to claim 1 wherein the dye is present in the dye bath in an amount in the range of 0.005 to 5.00 wt. % of the dye bath.

3. Process according to claim 1 wherein the molded plastic article contains urea formaldehyde resin or melamine formaldehyde resin along with a minor amount of filler selected from the group consisting of cellulose, paper pulp, glass-fiber, synthetic fibers, asbestos, wood flour, walnut shell flour or chopped cotton.

4. Process according to claim 1 wherein the molded plastic articles are buttons.

5. Process according to claim 1 wherein the residence time is in the range of 0.5 to 30 minutes when the dye is a dichlorotriazinyl dye.

6. A process according to claim 1 which includes:

a. recovering the dyed molded plastic articles from the dye bath; and b. treating the dyed molded plastic article in an after-treatment bth to fix or remove any non-fixed dye from the surface of the dyed molded plastic article.

7. A process according to claim 6 wherein the after-treatment bath is a water rinse.

8. A process according to claim 6 wherein the after-treatment bath is a soap bath.

9. Process according to claim 6 wherein the after-treatment bath is an alkaline bath.

10. A dyed urea formaldehyde resin containing button prepared in accordance with the process of claim 1.

11. A dyed urea formaldehyde resin containing button of claim 10 which includes:

a. 15 to 75 wt. % filler selected from the group consisting of cellulose, paper pulp, glass-fiber, synthetic fibers, asbestos, wood flour, walnut shell flour or chopped cotton.

12. A dyed melamine formaldehyde resin containing button prepared in accordance with the process of claim 1.

13. A dyed melamine formaldehyde resin containing button of claim 12 which includes:

a. 15 to 75 wt. % filler selected from the group consisting of cellulose, paper pulp, glass-fiber, synthetic fibers, asbestos, wood flour, walnut shell flour or chopped cotton.

* * * * *